US008910358B2

(12) United States Patent
Piepenburg

(10) Patent No.: US 8,910,358 B2
(45) Date of Patent: Dec. 16, 2014

(54) RADIATOR REPAIR JIG

(76) Inventor: Sarah Piepenburg, Black River Falls, WI (US)

( * ) Notice: Subject to any disclaimer, the term of this patent is extended or adjusted under 35 U.S.C. 154(b) by 29 days.

(21) Appl. No.: 13/568,967

(22) Filed: Aug. 7, 2012

(65) Prior Publication Data

US 2014/0041831 A1 Feb. 13, 2014

(51) Int. Cl.
*B23Q 1/00* (2006.01)

(52) U.S. Cl.
USPC ..... 29/283; 29/281.1; 269/155

(58) Field of Classification Search
CPC ..... B25B 5/003; B25B 5/006; B25B 5/082; B25B 5/101; B25B 5/14; B23P 19/04
USPC ..... 29/890.031, 281.1, 281.4, 281.6, 283; 269/89, 155, 156, 45, 143, 249, 3, 6, 269/270
See application file for complete search history.

(56) References Cited

U.S. PATENT DOCUMENTS

| | | | | | |
|---|---|---|---|---|---|
| 242,959 | A | * | 6/1881 | Naglee | 269/156 |
| 1,482,320 | A | | 1/1924 | Rosenfeld | |
| 2,364,150 | A | * | 12/1944 | Lowenstein | 269/203 |
| 2,506,051 | A | | 5/1950 | Young | |
| 2,537,350 | A | | 1/1951 | Hunt | |
| 2,606,583 | A | * | 8/1952 | O'Connor | 269/93 |
| 3,795,274 | A | | 3/1974 | Fieni | |
| 3,942,703 | A | | 3/1976 | Plegat | |
| 4,201,376 | A | * | 5/1980 | Philips | 269/156 |
| 4,957,257 | A | * | 9/1990 | Gonzalez | 296/156 |
| 5,174,004 | A | | 12/1992 | King et al. | |
| 5,597,047 | A | | 1/1997 | Thompson et al. | |
| 6,769,171 | B2 | | 8/2004 | Jung | |
| 7,032,283 | B2 | | 4/2006 | Tashiro et al. | |
| 2006/0081354 | A1 | | 4/2006 | Miura et al. | |

OTHER PUBLICATIONS

United States Army, Technical Manual . . . and Special Tools List, Mar. 2001, 2 pages, vol. 1, Army TM 9-2320-280-24-1, p. 0089.
United States Army, Technical Manual . . . and Special Tools List, Mar. 2002, 2 pages, vol. 1, Army TM 9-2320-387-24P, p. 0089.

* cited by examiner

*Primary Examiner* — Ryan J Walters
(74) *Attorney, Agent, or Firm* — Anthony J. Bourget

(57) ABSTRACT

A handheld jig for placement on a radiator and associated method to repair broken welds of tabs of a radiator mounting cradle used to hold a radiator of a vehicle such as a HMMVE where the tabs may be pressed against angled surfaces of the radiator, the jig having a base, a first arm extending from the base, a second arm extending from the base, and a third arm extending from the base, the first arm, second arm and third arm each capable of holding an adjustable pin to selectively contact a tab of the cradle to press the respective contacted tabs against respective angled surfaces of the radiator.

11 Claims, 10 Drawing Sheets

RADIATOR REPAIR JIG

BACKGROUND OF THE INVENTION

1. Field of the Invention

The present inventive concept relates generally to a device and method used to repair radiators, and more specifically to a handheld device and method for pressing parts to be welded.

2. Background Information

Radiators are included in vehicles of many varieties. Some vehicles, such as HMMWV or Humvee's, are used for travel over rough terrain and in stressful conditions, especially when used by soldiers or military personnel in training or combat. Radiators such as those used in a Humvee are mounted to the vehicle by using mounting brackets or tabs that hold the radiator in place. Particularly, the brackets or tabs are welded to the radiator. In turn the brackets or tabs, which are part of a radiator holding cradle, are connected to a frame of the vehicle to allow the radiator to be securely mounted to the vehicle. Due to excessive vibration and jarring when such vehicles are driven over uneven and rough terrain, the mounting brackets or tabs break loose from the radiator. Particularly, the welds that otherwise hold the mounting brackets or tabs to the radiator will break. Such condition requires repair, otherwise the radiator may continually vibrate and bend out of shape or position, potentially causing damage to the radiator and eventually harming the continued operation of the vehicle. When a radiator that flexes or wobbles in such stressful conditions experiences further stresses, the remaining mounting brackets or tabs absorb those stresses which results in swift deterioration and breaking of the remaining welds that hold the brackets or tabs to the radiator. If the condition persists, the radiator will become damaged. In some instances, the breaking of even one (or two) radiator mount bracket welds will result in the vehicle becoming not fully mission capable.

Accordingly, in order to keep the vehicle under good maintenance for use the welds need to be repaired or the radiator requires replacement, either of which can be expensive or time consuming and usually both.

SUMMARY OF THE INVENTION

The present inventor has recognized that the repair of the welds between the radiator and the mounting brackets/tabs is a difficult and time consuming process. The surfaces where the tab and radiator meet must be cleaned of dirt and debris and otherwise properly prepped in order to be securely welded. An important part of the welding process also requires the tab to be securely pressed against the radiator surface in order to make a solid weld attachment. Otherwise the weld will be too weak to provide a sufficient support and the weld will quickly break once the vehicle is back in operation. Thus, it is one object of the invention to assure the tabs are sufficiently pressed against the radiator so that a strong weld may be provided.

In most common Humvee designs, the tabs are welded to a radiator at the respective corners of the radiator. There are a series of tabs, typically three tabs, located at each corner. In some instances the weld of one or more tabs may have broken at a respective corner. Accordingly, an object of the present invention is to assure that the several tabs can be sufficiently pressed against the radiator. Ideally the several tabs can be simultaneously pressed against the radiator so that efficient welding of all tabs can be accomplished.

Importantly, the tabs used to hold a corner of a Humvee radiator are often secured to a portion or surface of the radiator that is angled. The angled surface complicates the secure holding of the tab to the radiator. A further aspect of the invention is to securely hold the tabs to these angled surfaces.

Heretofore the sufficient holding of tabs to the angled surfaces of a Humvee radiator required complicated and cumbersome arrangements of clamps or other devices, and then, given the nature of the orientation of such clamps or devices, only a single tab could be sufficiently held in position at a given time. The labor to hold a single tab in position in order to make a weld was extreme, and to rework clamps (in order to provide clearance to work on a tab) or reposition the radiator multiple times to secure multiple tabs sometimes lead to the complete discarding of an otherwise sound radiator. An object of the present invention is to provide a simple handheld jig to secure to a radiator so that a tab or multiple tabs may be securely held to the angled radiator surfaces so that the tabs may be welded to the radiator. A further object is to provide a simple handheld jig that may be universally used at all corners of the radiator to secure all of the tabs at the respective corners. Multiple jigs may also be used on a single radiator to increase the efficiency of the multiple welding operations needed for repair.

The above summary of the present invention is not intended to describe each illustrated embodiment, aspect, or every object or implementation of the present invention. The figures and detailed description that follow more particularly exemplify these and other embodiments and further aspects of the invention.

BRIEF DESCRIPTION OF THE DRAWINGS

The invention may be more completely understood in consideration of the following description of various embodiments of the invention in connection with the accompanying drawings, in which.

Figure 1:
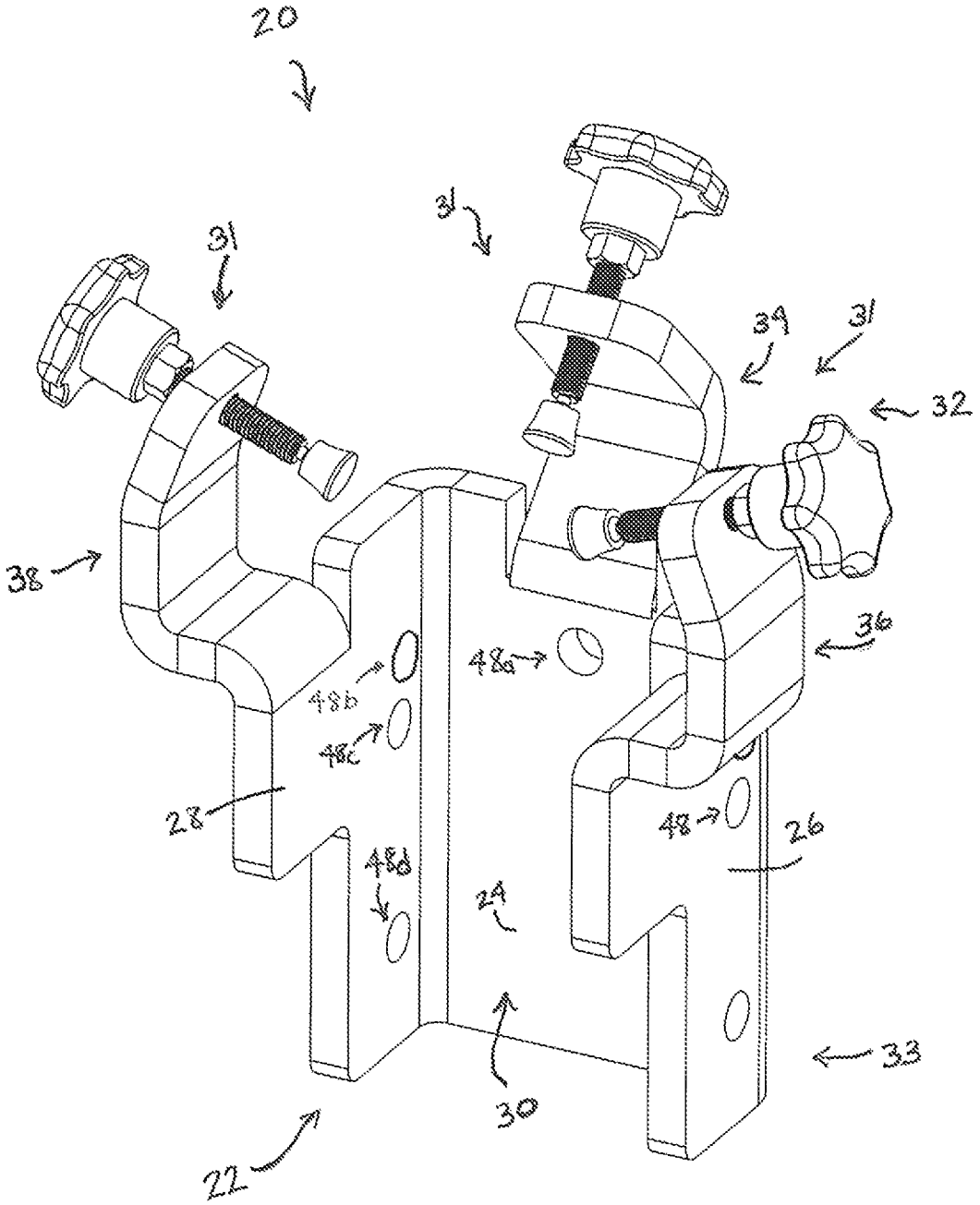
FIG. 1 is a perspective view of a jig according to one aspect of the invention.
Figure 2:
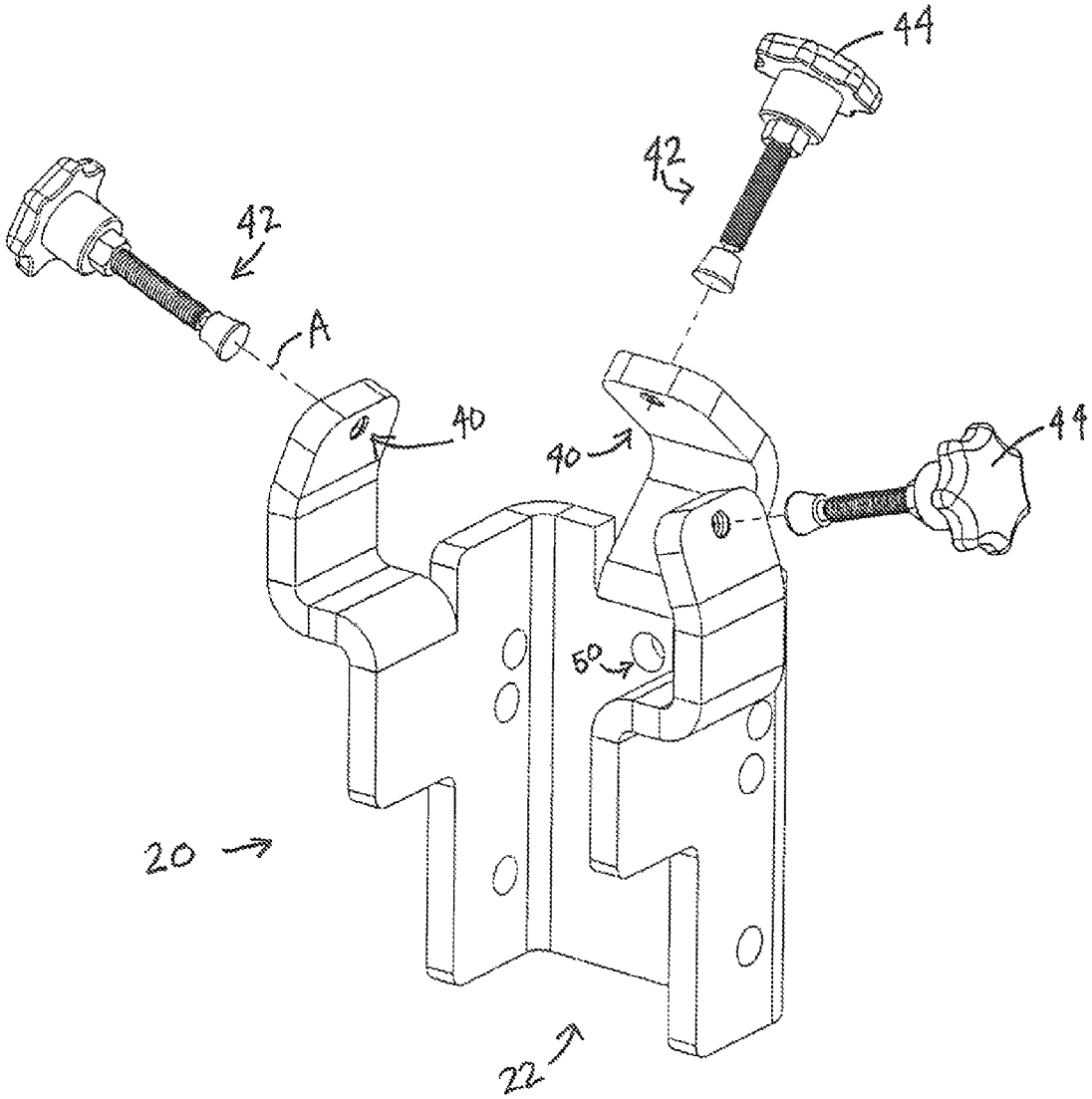
FIG. 2 is a perspective view of a further aspect of the invention.

While the invention is amenable to various modifications and alternative forms, specifics thereof have been shown by way of example in the drawings and will be described in detail. It should be understood, however, that the intention is not necessarily to limit the invention of the particular embodiments described.

DETAILED DESCRIPTION OF THE INVENTION

The following detailed description is not to be taken in a limiting sense, but is made merely for the purpose of illustrating the general principles of the invention, since the scope of the invention is best defined by the appended claims.

In one aspect the invention generally provides a jig for use on the corner regions of a radiator to hold tabs of a radiator mounting cradle tight against angled surfaces of the radiator so the tabs can be welded to the angled surfaces. The jig attaches to an edge of the radiator and includes angled arms extending from the jig and configured to accommodate threaded pins which apply force to the tabs which are angled and contact the angled surfaces of the radiator to be welded.

According to exemplary aspects of the invention (FIGS. 1 to 14), jig 20 includes a base 22 having an edge piece 24 and side pieces 26, 28. Edge piece 24 is preferably a plate made of metal such as steel and having a width W sufficient to span across an edge of a radiator R. Side pieces 26, 28 are also preferably a plate made of metal and connect to edge piece 24 preferably integrally connected at right angles generally as shown (See FIG. 1). Edge piece 24 and side pieces 26, 28 form a cavity 30 which receives radiator R. Jig 20 may be positioned generally at a corner region 114 of the radiator R.

While radiator R may represent a variety of types of radiators, jig 20 is particularly well suited for use with a radiator of a HMMWV or Humvee vehicle. Some of the HMMWV vehicle varieties that have a radiator R for which jig 20 may be used include those as referenced in U.S. Army Technical Manual (TM 9-2320-387-24P) such as model Nos. M1114, M114, M1115, M1151A1, M1152, M1152A1, M1165, M1165A1, M1167, and U.S. Army Technical Manual (TM 9-2320-280-24P-1) such as model Nos. M998A1, M1038A1, M1123; M966A1, M1045A1, M1046A1, M1025A1, M1026A1, M1043A1, M1044, M996A1, M1035A2. Such radiator R (See FIG. 8 and FIG. 9, for instance, showing a radiator in broken lines or phantom) includes a pair of generally planar and opposing side portions 100, generally planar and opposing edge portions 102, a top portion 104, and an opposing bottom portion 106. In one example radiator R has a thickness of about 3 9/16 inches (3.880 inches), a height of about 28.38 inches and width of about 28.25 inches. Newer models of HMMWV include a height of about 35.5. Jig 20 is configured to work on both new and older HMMWV radiator models. Top portion 104 and bottom portion 106 have a variety of angled surfaces 108. An "angled surface" as used herein is a surface that lies on a plane substantially different than a plane defined by side portions 100 or edge portions 102. A radiator mounting cradle 110*a* and 110*b* are typically positioned on edge portions 102 of Radiator R. Mounting cradle 110 is used to secure radiator R to the vehicle or HMMWV. Cradle 110 includes tabs 112 which extend beyond side portions 100 toward top portion 104 and bottom portion 106. Preferably tabs 112 are securely welded to angled surfaces 108. Particularly, tab 112*a*, for instance, will be securely welded to angled surface 108*a*, and tab 112*b* will be securely welded to angled surface 108*b* (See FIG. 9). Preferably tabs 112 of mounting cradle 110 will be securely welded to their respective angled surfaces 108 of radiator R. When such welds are not present or have been broken or weakened, jig 20 is used to assist in the repair of the welds as provided herein. In one aspect, HMMWV radiator R includes angled surface 108*a* which lies on a plane generally oriented at about 40 degrees with respect to a plane defined by edge portion 102 (i.e., angled surface 108*a* slopes upward along edge portion 102 at an angle of about 40 degrees; See FIG. 11). In another aspect, HMMWV radiator R includes angled surface 108*b* which lies on a plane generally oriented at about 25 degrees with respect to a plane defined by side portion 100 (i.e., angled surface 108*b* slopes upward from along portion 100 at an angle of about 25 degrees; See FIG. 12).

Figure 14:
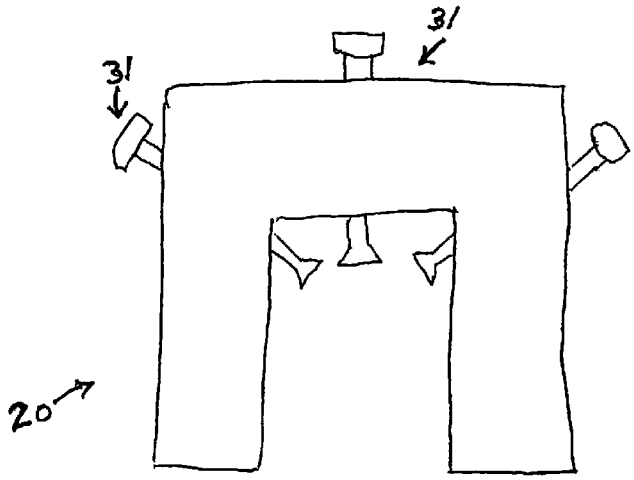
FIG. 14 is a top view of the feature of FIG. 13.
Figure 13:
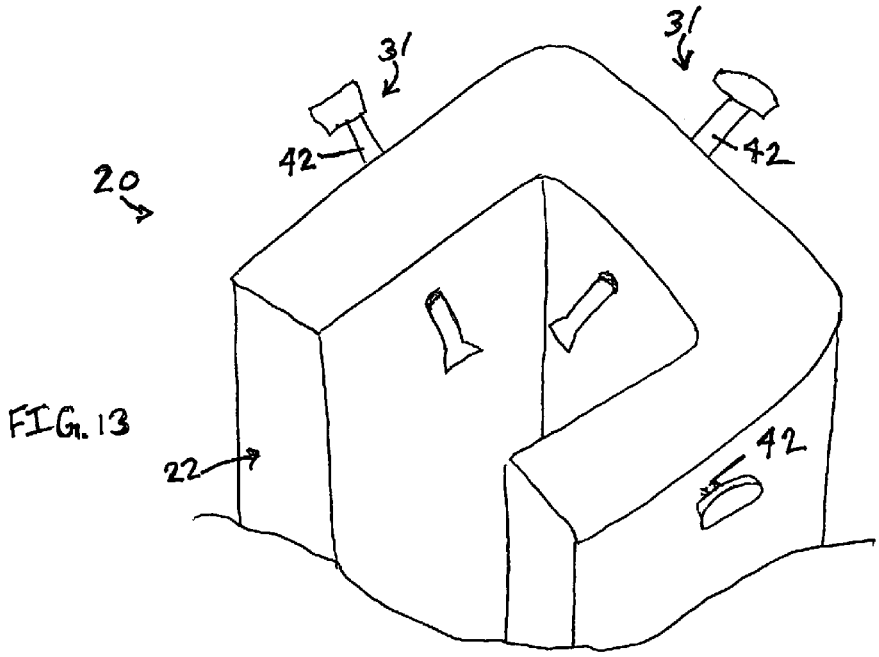
FIG. 13 is a partial perspective view of a further aspect of the invention.

Base 22 includes force exerting means 31 for selectively exerting a force against a tab 112 to press the tab 112 against the angled surface 108 of the radiator R. Force exerting means 31 may include, for instance a threaded means for threading a pin or bolt to tighten the pin or bolt against tab 112, or a ratchet mechanism to slide a pin or bolt to tighten against tab 112, or other mechanism for exerting force on tab 112. In one preferred aspect force exerting means 31 includes a threaded aperture 40 as described further herein. Force exerting means may also include a threaded pin in conjunction with the aperture 40 which may be positioned on an arm, i.e., arm 34, 36 38, which extends from base 22 (See FIGS. 1-10). In other aspects, force exerting means 31 may include an aperture 40 and also pin 42 as generally shown in FIGS. 13-14.

Edge piece 24 and each side piece 26, 28 preferably include an extending arm. Edge arm 34 extends from edge piece 24 generally at an upper portion 32 of base 22. Particularly, edge arm 34 includes a first segment 34*a* which extends rearward of base 22 and away from side arms 36, 38 (See FIG. 5). First segment 34*a* also extends upward from base 22 and away from lower portion 33. A second segment 34*b* extends from the first segment 34*a* upward and toward side arms 36,38. In one aspect second segment 34*b* extends generally perpendicularly from first segment 34*a*, yet it may be appreciated that a variety of angles may be used for such features. It may also be appreciated that a variety of segments may also be used to comprise edge arm 34 and this aspect is not limited to the two segments as shown. In one aspect base 22 may have a height of about 7.5 inches with arm 34, 36, 38 extending above base 22.

Side arm 36 extends from side piece 26. Side arm 36 includes a first segment 36*a*, a second segment 36*b* and a third segment 36*c* (See FIG. 3). It may be appreciated that a variety of segments may also be used to comprise side arm 36 and the segments may be positioned at a variety of angles to accommodate use with the different angled surfaces of radiator R. In the present aspect, while segment 36*a* extends generally perpendicularly from side piece 26, a different angle may be used (such as that used with segment 34*a*, above, or other angle). Preferably segment 36*a* extends away from side piece 28. By making such extension, arm 36 provides clearance so that a user may more readily access the area of tab 112 to be welded. Preferably pin 42 and footer 46 are of relatively small diameter so as to maximize the available operation space in the area where a tab 112 presses upon an angled surface 108. It may be appreciated that in an alternative aspect, base 22 itself may be configured to receive pins 42 (without having extending arms extending from base 22) as generally shown in FIG. 13 and FIG. 14. It may also be appreciated that alternative force mechanisms (such as ratchets or clamps) may be used in conjunctions with base 22 instead of or in addition to using pins 42 or threaded pins and threaded apertures 40. Having arms 34, 36, 38 preferably extending from base 22, however, allows for greater operating areas to make welding access easier. Use of arms also allows for base 22 to be made of less material as compared to a base shown in FIG. 13.

Side arm 38 extends from side piece 28. While not required, the configuration of side arm 38 extending from side piece 28 is preferably a mirror image of the structure of side arm 36 noted above (see for instance, FIG. 4).

Positioned at an upper portion within each arm 34, 36, 38 is an aperture. Aperture receives a pin which preferably extends to contact a tab 112 when jig 20 is positioned at a corner region 114 of radiator R. Preferably aperture is a threaded aperture 40 which receives a threaded pin 42. Pin 42 includes a handle 44 so pin may be turned. Pin 42 preferably includes a footer 46 which is free to articulate at the end of pin 42

(preferably a ball joint connection) so that footer may self-adjust when it contacts a tab 112. Preferably aperture 40 is oriented such that a pin threaded therein is oriented with the angles as noted herein.

Body 22 also includes ports 48 through which fasteners 49 may be inserted in order to attach jig 20 to radiator R. A port 48*a* is typically included at edge piece 24, and a fastener, such as a threaded fastener may be inserted through port 48 to thread within a receiving port positioned within radiator R. In this manner the preexisting receiving ports of radiator R may be used to secure jig 20. Additional ports such as ports 48*b* and 48*c* may be included in side piece 28 (See FIG. 5) to accommodate securing jig 20 to radiator R. Optional ports such as optional port 48*d* may also be included in cases where a variety of types of radiators having different aperture locations are being repaired. A port 48*d* may also be included on side piece 26 as desired. Port 48*b* is used when securing jig 20 to radiator at a position shown in FIG. 10 since port 48*b* aligns with a preexisting receiving port toward a bottom portion of radiator R. When jig 20 is flipped upright as shown in FIG. 1 (or and FIG. 5, port 48*c* is used to secure a fastener to a preexisting receiving port of radiator R. The arrangement of various ports 48 can be altered to accommodate use with a variety of types of radiators or other devices in need of clamping and/or welding.

Figure 6:
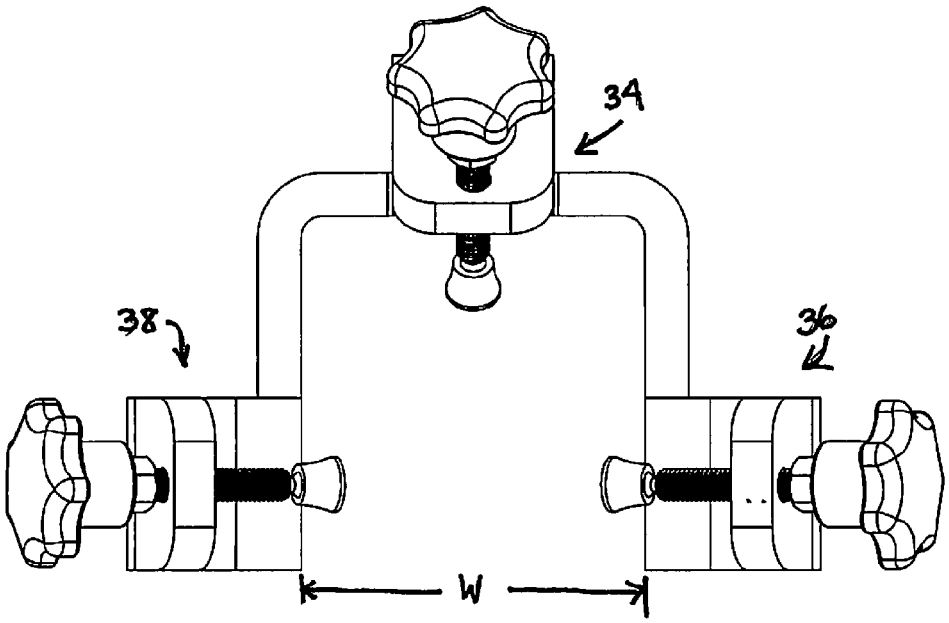
FIG. 6 is a top view of the feature of FIG. 1.

Preferably arms 34, 36, and 38 are oriented at right angles to each other as generally shown in FIG. 6. Preferably at least one arm 38 is positioned opposite another arm 36.

Figure 3:
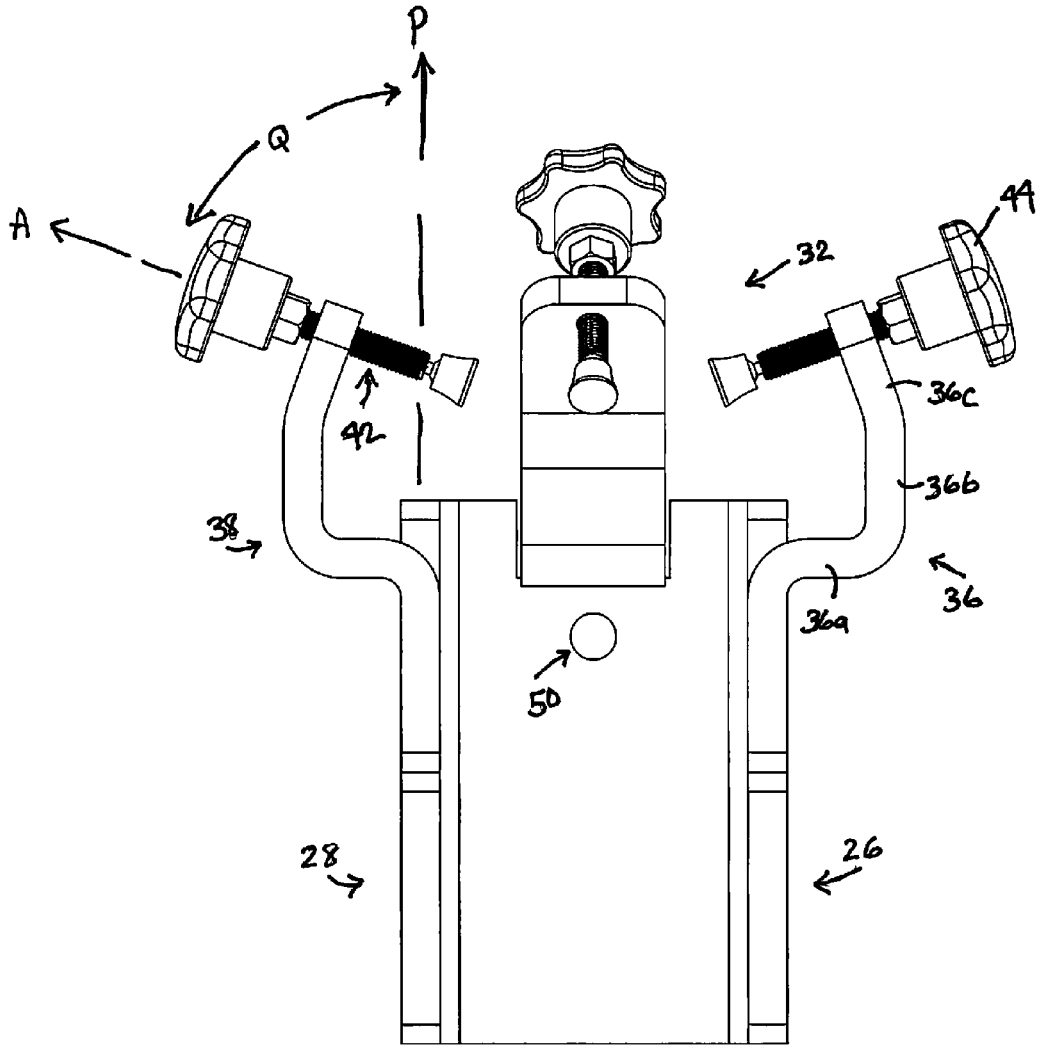
FIG. 3 is a front view of the feature of FIG. 1.
Figure 4:
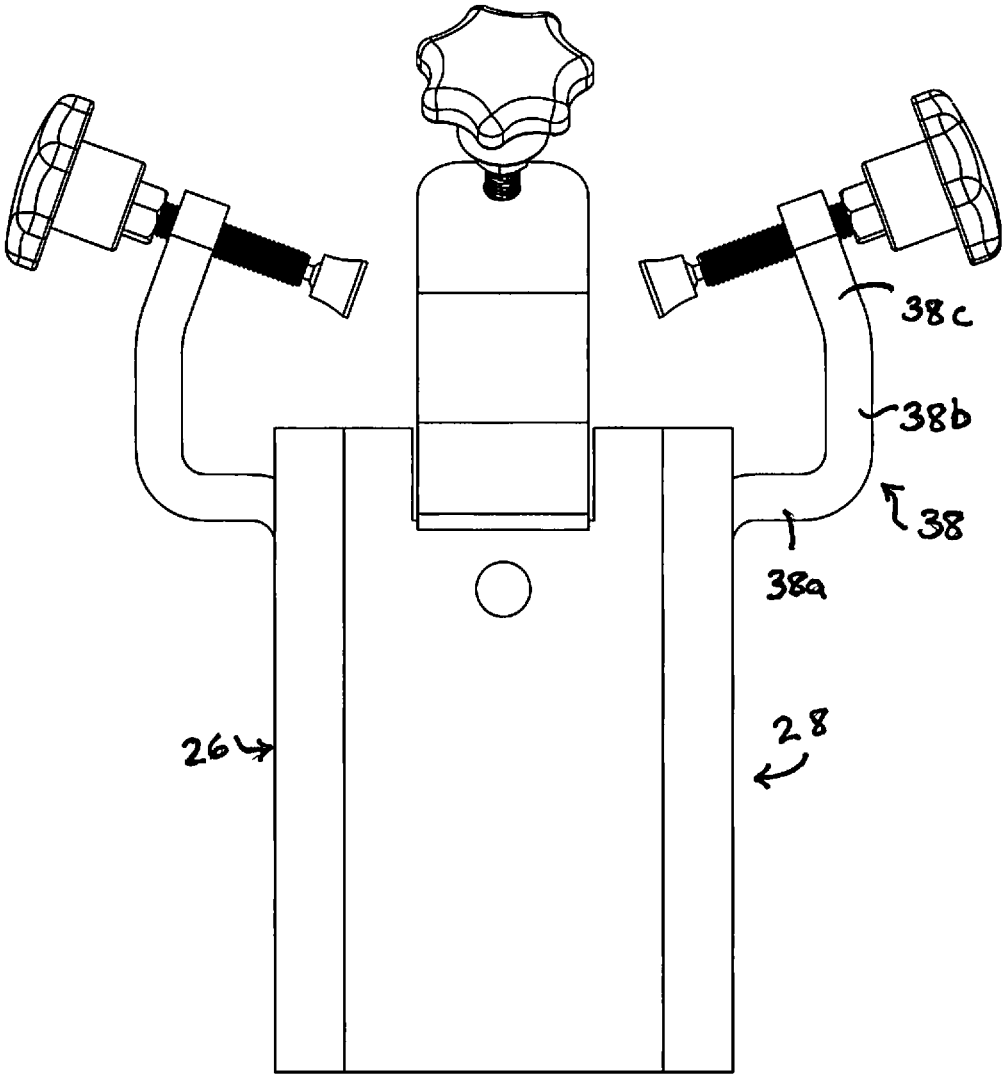
FIG. 4 is a back view of the feature of FIG. 1.
Figure 5:
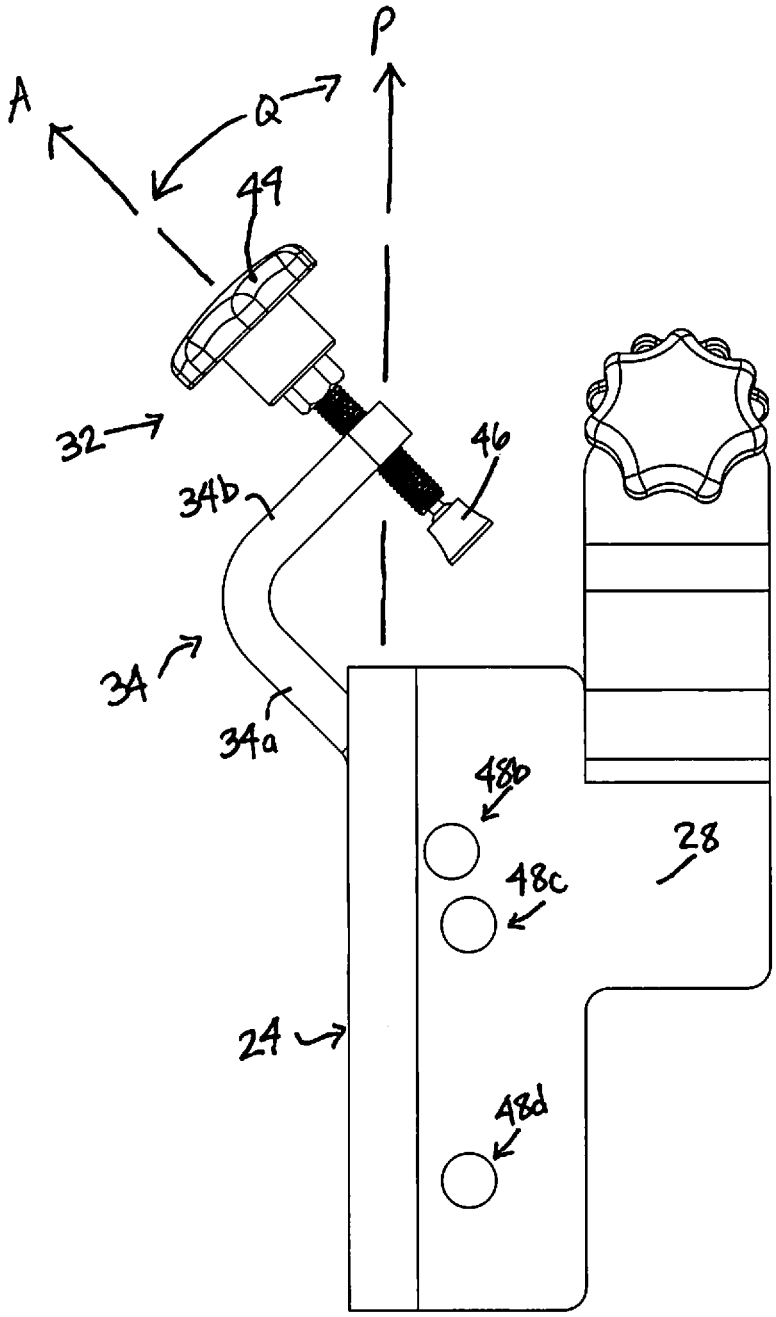
FIG. 5 is a left side view of the feature of FIG. 1.
Figure 7:
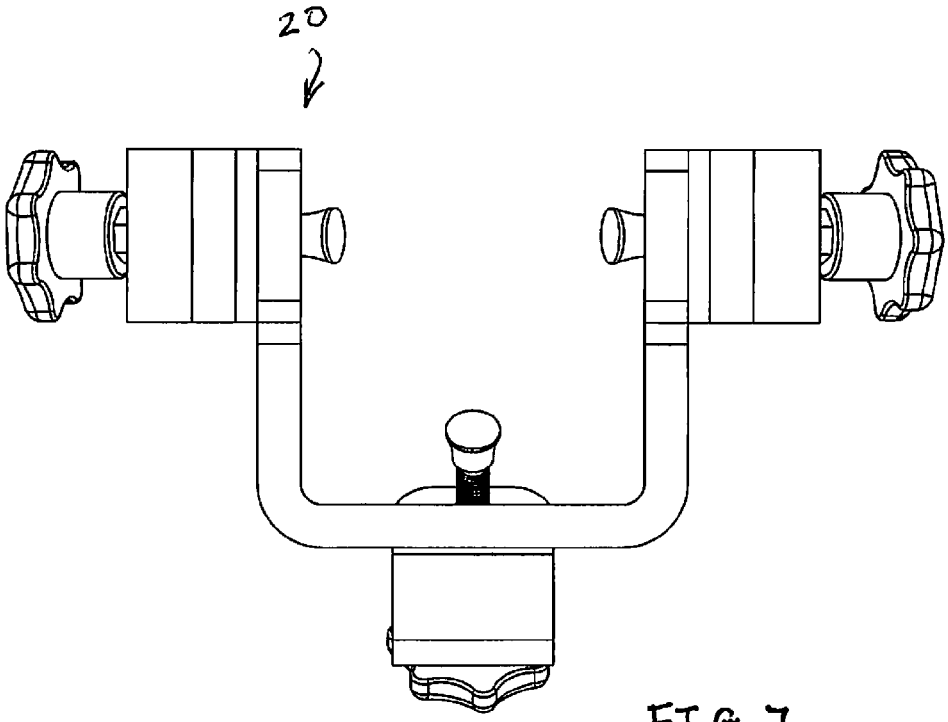
FIG. 7 is a bottom view of the feature of FIG. 1.

While jig 20 preferably includes three arms 34, 36, 38 generally as shown, in a further aspect it may be appreciated that jig 20 includes fewer than three arms. At least one arm (such as arm 34 or 36 or 38) includes an upper portion defining an aperture 40 having a central axis A running therethrough (the central axis generally depicted by the reference line A in FIG. 2 and FIG. 3). Axis A is oriented such that it crosses a plane P defined by the side piece 26, 28 (or alternatively defined by the edge piece 24) at an acute angle Q (See FIG. 3, and FIG. 5, for instance). For further reference, the acute angle Q of the intersection of Axis A and plane P is an exterior acute angle also oriented toward the upper portion 32 of base 22. For further reference, the angle opposite angle Q is the interior acute angle. While angle Q is preferably the same as the angle defined by side portion 100 and angled surface 108*b* (or alternatively the angle defined by edge portion 102 and angled surface 108*a*), variations between such angles is acceptable for use in this aspect. Preferably angle Q in FIG. 3 is between 70 and 20 degrees, and most preferably is about 65 degrees in this aspect. Preferably angle Q in FIG. 5 is between 70 and 20 degrees, and most preferably is about 40 degrees in this aspect. Footer 46 provides further refined angling adjustment upon contact of footer 46 with tab 112*b* (or tab 112*a*).

Jig 20 may be manufactured from metal such as steel or other metal, and molded or bent into shape with general machining and finishing and coating techniques.

Figure 8:
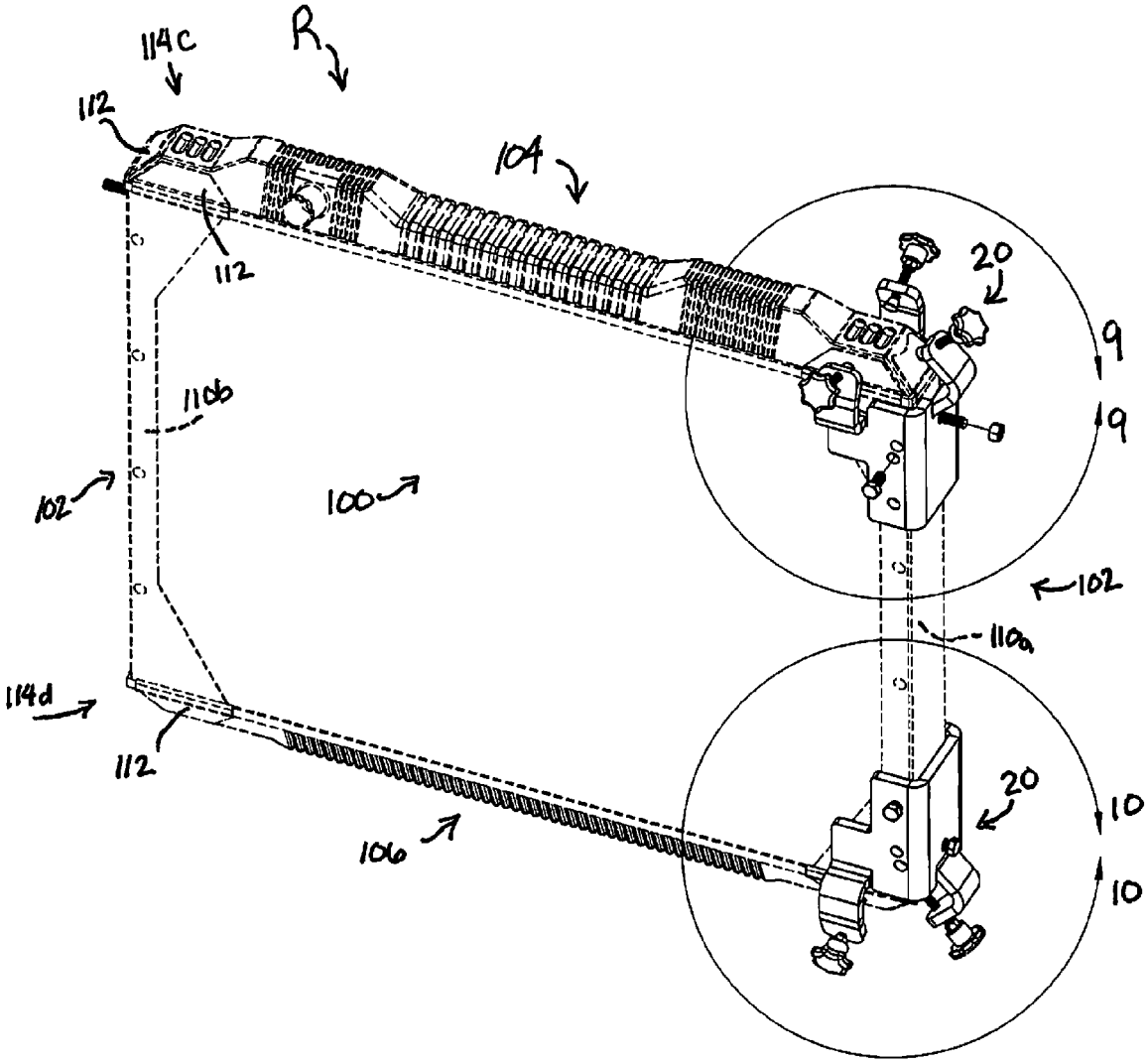
FIG. 8 is a perspective view of a further aspect of the invention.
Figure 9:
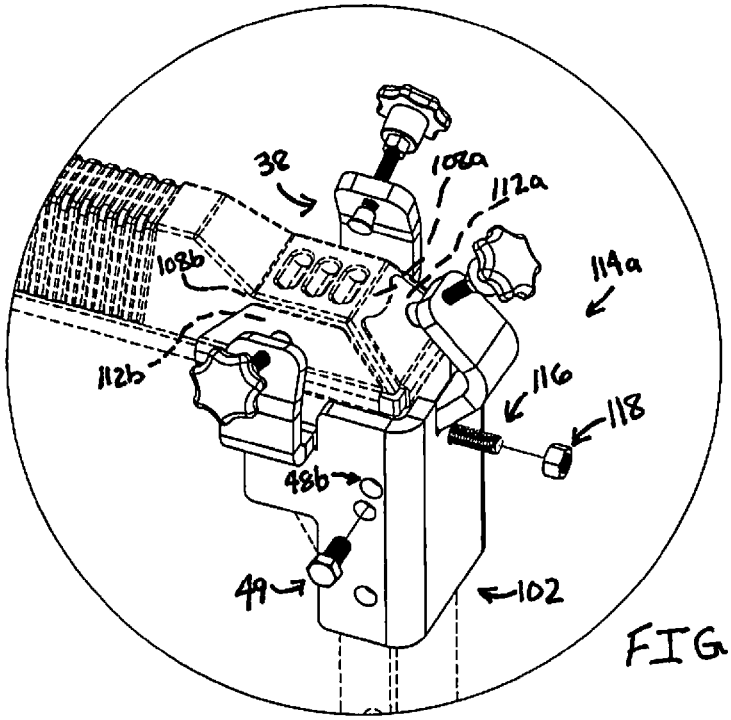
FIG. 9 is a partial view of the aspect of FIG. 8 shown in detail along arrow 9-9 in FIG. 8.
Figure 10:
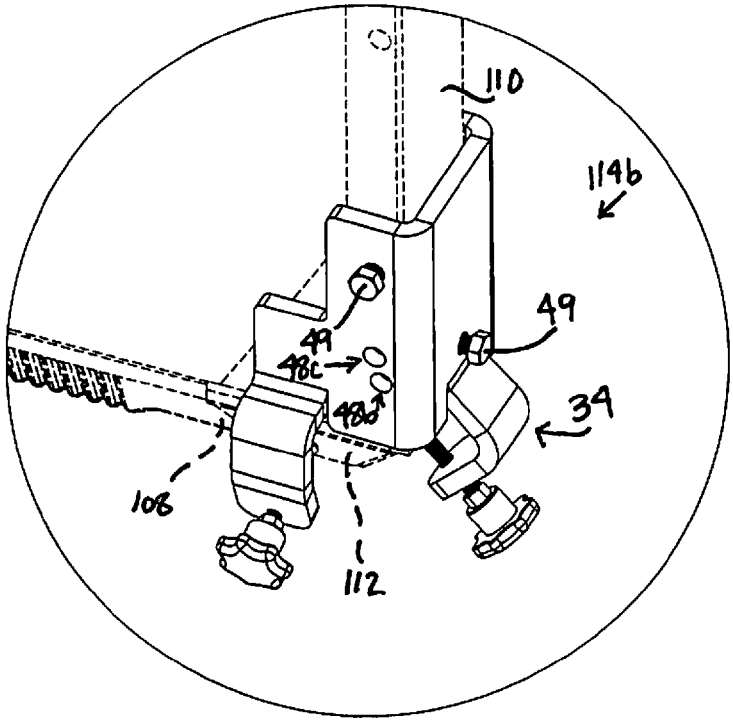
FIG. 10 is a partial view of the aspect of FIG. 8 shown in detail along arrow 10-10 in FIG. 8.
Figure 11:
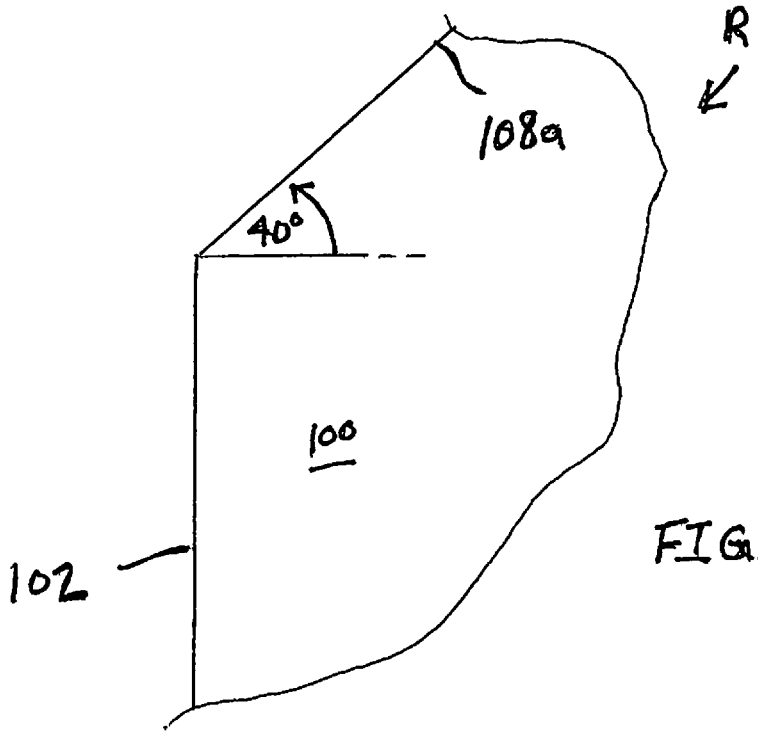
FIG. 11 is a partial rear view of a feature of a radiator for which one aspect of the invention may be used.
Figure 12:
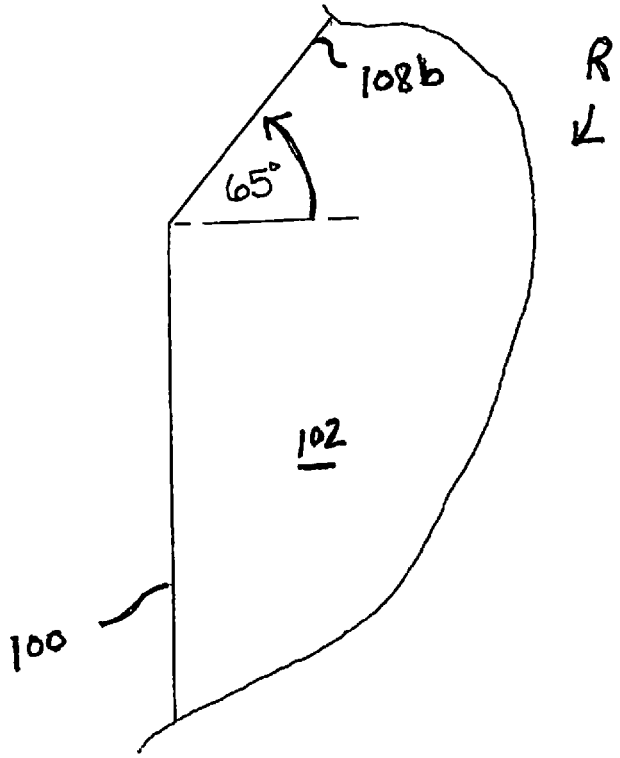
FIG. 12 is a partial end view of a feature of a radiator for which one aspect of the invention may be used.

In operation, jig 20 may be used to assist in repair of a variety of types of objects having angled surfaces, and is particularly well-suited for use in repair of a radiator R. In a case where the welds that hold tabs 112 to the radiator R require repair, such as at tabs 112*a* and 112*b*, the respective angled surface or surfaces, 108*a*, 108*b* will be cleaned and prepared for welding. Any dirt or loose debris, or prior weld slag or other material can be sanded or otherwise removed. The underside of a tab 112 or respective tabs will also be cleaned. Tabs 112 may be carefully bent outward in order to make an appropriate cleaning, being careful to not crack or break tabs 112. Once tabs 112 and angled surfaces 108 are cleaned and prepared for welding, jig 20 is placed upon a corner region 114 of radiator R, generally as shown in FIGS. 8-10. As shown in FIGS. 8-10, jig 20 is configured to fit at a corner region 114 (or at alternate corner regions 114) of radiator and at least partially cover edge portion 102 and side portions 100 of the radiator. Particularly, jig 20 overlays mounting cradle 110 which also overlays, at least partially, edge portion 102 and side portions 100 of radiator.

When jig 20 is in position, a series of fasteners 49 may be inserted through ports 48 and into preexisting threaded apertures of radiator R. Fasteners 49 may be secured so that jig 20 does not move. In reference to FIG. 9, radiator includes a stud 116 which extends from the edge portion 102 of radiator. Stud 116 is typically a welded bolt having threads. Stud 116 is used to connect radiator to a frame or other support of a vehicle. Stud 116 is directly connected to radiator and is present when the radiator is removed for repair (unless stud 116 has been broken). Stud port 50 is provided in base 22 so that stud 116 may pass through port 50. Typically jig 20 will be placed at corner region 114 (upper corner regions 114) by first inserting stud 116 through port 50 and then placing base 22 on corner region 114 as shown. In a typical HUMVVE vehicle, stud 116 is present only at the upper corner regions 114. Preferably a threaded nut 118 or other fastener may be included with stud 116 to secure jig 20 in position. Additional festers 49 may also be inserted through base 22 and into threaded apertures of the radiator as desired. It may be appreciated that as an alternative, stud port 50 may be a slot or elongated slot which may accommodate insertion of stud 116 into slot by sliding base 22 upon corner region 114 so that stud 116 slides within the slot.

When jig 20 is firmly connected to radiator R, pins 42 may be adjusted to contact and apply a force to tabs 112. In one aspect, turning handle 44 clockwise, for instance, will adjust pin 42 in a direction opposite arrow A as shown in FIG. 3 to apply a force to tab 112. A similar turning of handle 44 will adjust pin 42 within side arm 36 to force tab 112*b* against angled surface 108*b*. A similar turning of handle 44 will adjust pin 42 within edge arm 34 to force tab 112*a* against angled surface 108*a*. In such manner all tabs 112, or only one or two tabs 112, may be held, individually or simultaneously, against their respective angled surfaces 108 for a welding operation. Alternate force exerting means 31 may be used as noted herein to apply force. Once a tab is held in firm contact with the surface, the weld is applied as is commonly understood. Multiple jigs 20 may be used simultaneously to repair various tabs 112 of a radiator R. It may be appreciated that jigs 20 may be secured to several radiators R for an efficient group repair of multiple radiators R.

A further aspect of the invention is the method of selectively exerting force against a mounting cradle tab 112 to position the tab 112 against an angled surface 108 of a radiator R by utilizing a handheld jig 20 having at least one arm (such as edge arm 34 or side arm 36, 38) extending from a plate piece (such as edge piece 24 or side piece 26, 28). The arm includes a force exerting means 31 for exerting a force upon tab 112 to force tab 112 against the angled surface 108. In one aspect the force means includes a pin 42 (force means may also include use of levers, threads, ratchets, gears, rack and pinion, or other force producing means to press against tabs). Pin 42 is preferably threaded and has a central axis A (See FIG. 3 and FIG. 5) oriented at an exterior acute angle Q (with respect to a plane P defined by the edge piece 24 (or side piece 26, 28)) and when pin 42 is turned, it exerts a force to press tab 112 against angled surface 108*a* (See FIG. 9). Jig 20 is secured to radiator R by use of fasteners 49. Once jig 20 is secured, pins 42 may be turned which presses tabs 112 against angled surfaces 108. A single tab 112 or multiple tabs 112 may be pressed as needed. In further operation pins 42 may be pressed against respective tabs 112 to press the tabs 112 against respective angled surfaces 108. Tabs 112 may then be welded to repair radiator R. After the welding has set, jig 20 may be reused for another radiator repair event or stored in a cabinet, drawer or other location. The same jig 20 may be used at any of the corner regions 114*a*, 114*b*, 114*c*, 114*d* of radiator R. Multiple jigs 20 may be used on a single radiator, and multiple radiators may be repaired with the assistance of several jigs 20.

It should be understood, of course, that the foregoing relates to exemplary embodiments of the invention and that modifications may be made without departing from the spirit and scope of the invention as set forth in the following claims.

What is claimed is:

1. A jig for placement on a radiator, said jig comprising:

a base configured to fit at a corner region of the radiator and at least partially cover an edge portion and side portions of the radiator, said base including a first port configured to receive a stud of the radiator when said jig is positioned at the corner region of the radiator and a second port configured to align with an aperture of the radiator;

a first arm extending upward and outward from said base and having force exerting means for selectively exerting a downward force against at least one tab of a radiator mounting cradle associated with the radiator;

a second arm extending upward and outward from said base and having second force exerting means for exerting a downward force against at least a second tab of the radiator mounting cradle; and a third arm extending upward from said base and having third force exerting means for exerting a downward force against at least a third tab of the radiator mounting cradle.

2. The jig of claim 1 where said second force exerting means includes a pin threaded into an aperture of said second arm.

3. The jig of claim 2 where said pin includes a self-adjusting footer at one end and a handle at an opposite end.

4. The jig of claim 1 where said jig is a handheld jig and where said force exerting means includes an aperture configured to receive a threaded pin capable of contacting the at least one tab.

5. The jig of claim 1 where a top end of said first arm is angled inward toward said base.

6. A handheld jig for placement on a radiator in order to apply force to tabs of a radiator mounting cradle so that the tabs may be pressed against angled surfaces of the radiator, said jig comprising:

a base having an edge piece configured to be placed over an edge portion of the radiator, said edge piece having a first port configured to receive a stud extending from the radiator, said base having a side piece having a second port; and a first arm extending from said edge piece and including a first force exerting means for exerting a force against a tab of the cradle so that the tab may be pressed against an angled surface of the radiator, and a second arm extending from said base and including a second force exerting means for exerting a force against a tab of the cradle, and a third arm extending from said base and including a third force exerting means for exerting a force against a tab of the cradle, said first force exerting means connected to said first arm at a position above said first port, said second force exerting means connected to said second arm at a position above said first port, said third force exerting means connected to said third arm at a position above said first port, said first port positioned above said second port.

7. The jig of claim 6 where said third arm extends from a side piece having a third port, said third port positioned below said first port.

8. A jig for exerting force against separate components of an object, said jig comprising:

a base having a first side piece generally perpendicularly connected to an edge piece and a second side piece generally perpendicularly connected to said edge piece, said first side piece said second side piece and said edge piece defining a cavity configured to receive the object, said edge piece including a first port;

a first arm extending upward from said first side piece in a first direction and having a pin configured to exert a downward force against a component of the object;

a second arm extending upward from said second side piece in the first direction and having a second pin configured to exert a downward force against a second component of the object; and a third arm extending upward from said edge piece in the first direction and having a third pin configured to exert a downward force against a third component of the object.

9. The jig of claim 8 where said first arm, said second arm and said third arm are integrally connected to said base.

10. The jig of claim 8 where said first port is configured to receive a stud of the object.

11. The jig of claim 8 where said first side piece and said second side piece are integrally connected to said edge piece.

* * * * *